US007585468B2

(12) United States Patent
Jaghuber

(10) Patent No.: US 7,585,468 B2
(45) Date of Patent: Sep. 8, 2009

(54) ELECTRONIC PIPETTE

(75) Inventor: Bernd Jaghuber, Uetersen (DE)

(73) Assignee: Eppendorf AG, Hamburg (DE)

( * ) Notice: Subject to any disclaimer, the term of this patent is extended or adjusted under 35 U.S.C. 154(b) by 751 days.

(21) Appl. No.: 11/062,385

(22) Filed: Feb. 22, 2005

(65) Prior Publication Data

US 2005/0232819 A1 Oct. 20, 2005

(30) Foreign Application Priority Data

Apr. 1, 2004 (DE) ..... 10 2004 016 003

(51) Int. Cl.
*B01L 3/02* (2006.01)

(52) U.S. Cl. ..... 422/100; 73/864.01

(58) Field of Classification Search ..... 422/100; 73/863.02, 864.14, 864.16, 864.11, 864, 73/18

See application file for complete search history.

(56) References Cited

U.S. PATENT DOCUMENTS

| | | | | | |
|---|---|---|---|---|---|
| 3,530,734 | A | * | 9/1970 | Wray et al. | 74/89.3 |
| 4,041,764 | A | | 8/1977 | Sabloewski et al. | |
| 4,478,094 | A | * | 10/1984 | Salomaa et al. | 73/863.32 |
| 4,821,586 | A | * | 4/1989 | Scordato et al. | 73/864.18 |
| 4,896,270 | A | * | 1/1990 | Kalmakis et al. | 700/240 |
| 5,187,990 | A | | 2/1993 | Magnussen | |
| 5,330,717 | A | * | 7/1994 | Berteloot et al. | 422/68.1 |
| 5,543,672 | A | * | 8/1996 | Nishitani et al. | 310/77 |
| 5,620,661 | A | * | 4/1997 | Sch urbrock | 422/100 |
| 5,747,897 | A | * | 5/1998 | Iwasa et al. | 310/49 R |
| 5,892,161 | A | | 4/1999 | Conley et al. | 73/864.18 |
| 5,955,808 | A | * | 9/1999 | Hill | 310/180 |
| 5,998,218 | A | * | 12/1999 | Conley et al. | 436/180 |
| 6,085,599 | A | * | 7/2000 | Feller | 73/861.13 |
| 6,166,475 | A | * | 12/2000 | Furuki | 310/261 |
| 6,254,832 | B1 | * | 7/2001 | Rainin et al. | 422/100 |
| 6,499,365 | B1 | * | 12/2002 | Baumgartner | 73/864.16 |
| 7,284,453 | B2 | * | 10/2007 | Li et al. | 73/863.01 |
| 2004/0057875 | A1 | | 3/2004 | Bigus | |

FOREIGN PATENT DOCUMENTS

| | | |
|---|---|---|
| WO | WO 91/16974 | 11/1991 |
| WO | WO 98/10265 | 3/1998 |

OTHER PUBLICATIONS

Microchip Technology Inc. DS00907A published Jan. 26, 2004.*

* cited by examiner

*Primary Examiner*—Jill Warden
(74) *Attorney, Agent, or Firm*—Vidas, Arrett & Steinkraus, P.A.

(57) ABSTRACT

Electronic pipette with a displacement device, an electric drive motor with a drive shaft, a gear mechanism coupled on the one hand to the displacement device and on the other hand to the drive shaft, a magnetic disc rotationally coupled to the drive shaft with at least one magnetic pole on the circumference, at least one magnetic sensor aligned with the circumference of the magnetic disc, at least one additional magnet aligned with the circumference of the magnetic disc, an electronic control device electrically connected to the electric drive motor and the magnetic sensor and an electric voltage supply connected to the electronic control device.

19 Claims, 1 Drawing Sheet

ELECTRONIC PIPETTE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

Electronic pipettes are used in the laboratory for metering fluids. They are known in different embodiments. Air cushion pipettes have an integral cylinder with a piston arranged therein. The cylinder is attached to an aperture in a fastening shoulder via a channel. A pipette tip can be releasably connected to the fastening shoulder. By displacing the piston in the cylinder, test fluid is drawn into the pipette tip or ejected therefrom. In this connection, the piston and cylinder do not come into contact with the fluid, as the piston moves the fluid indirectly via the air cushion. Only the pipette tip, which generally consists of plastics, is contaminated and can be exchanged after use.

Direct-displacement pipettes can be releasably connected to a syringe, of which the piston can be driven by means of the pipette in order to draw test fluid directly into the syringe and eject it therefrom. As the syringe is contaminated with the test fluid, it can be exchanged. The syringe also generally consists of plastics.

Pistonless pipettes can comprise a metering tip with a balloon-like end portion which is expanded to draw in test fluid and compressed to eject it. Such metering tips have also already been designed as exchangeable parts made from plastics.

When pipetting, the pipette dispenses the fluid received by the tip or syringe in one step. When dispensing, the fluid received by the syringe or the tip is dispensed in small quantities.

Multi-channel pipettes comprise a plurality of channels by means of which metering can take place simultaneously. Pipettes can be designed as hand-held apparatus and/or stationary apparatus.

All the aforementioned pipettes are electronic pipettes in the sense of this application. For precise metering of a volume of fluid, it is necessary to displace the piston in the cylinder or the displaceable element of a further displacement device, as precisely as possible, depending on the volume of fluid.

An electronic pipette is known from WO 91/16974 A1 which comprises a measurement device for measuring the distance travelled by the piston and a braking device controlled by a control device to arrest the piston. The braking device comprises grooves on the circumference of a rotating disc coupled to the electric drive motor and a cam which can be forced into a groove by a drive. With this pipette the piston is arrested by means of the brake as soon as the measuring device establishes that the piston has travelled the required distance for the desired metering. The mechanical braking of the piston by means of the brake is prone to wear and tear. As a result, trouble-free operation of the pipette over a lengthy period of use is not guaranteed.

Moreover, electronic pipettes are known in which the electric drive motor is coupled to a magnetic rotational angle sensor which comprises alternate magnetic poles on the circumference of a magnetic disc. A magnetic sensor is aligned with the circumference of the magnetic disc. The number of different magnetic poles on the circumference of the magnetic disc is restricted. Furthermore, the passing through of different poles can only be determined sufficiently reliably by means of the magnetic sensor. However, the exact position of the magnetic disc cannot be measured by the sensor in the space between the poles. As a result, the resolution of the magnetic rotational angle sensor and thus the precision of the metering is reduced. Moreover, oscillation controllers are possible with the rotational movements of the magnetic disc, which are limited by the spacing between the different poles.

Proceeding from this, the object of the invention is to provide an electronic pipette with trouble-free and precise control of the volume of fluid to be metered over a lengthy period of use.

U.S. Pat. No. 5,892,161 and WO 98/10265 A1 disclose a mechanical pipette with electronic display, which comprises a transducer arrangement to monitor the rotational movement of a volume delivery adjustment device of the pipette. The transducer arrangement preferably comprises two Hall-effect sensors which are spaced 90 rotational degrees apart from one another and detect the magnetic field of an annular magnet which is attached to the volume delivery adjustment device. The Hall-effect sensors produce sinusoidal signals which are 90° out of phase from one another. The signals are processed in order to determine the absolute position of the volume adjustment mechanism and to display the volume delivery adjustment of the pipette. The transducer arrangement, in conjunction with the electronics assembly, monitors both the number of revolutions of the volume adjustment mechanism from an initial position and the position of the volume adjustment mechanism within a revolution.

The electronic processing of the signals emitted by the Hall-effect sensors to establish precisely the rotational position of the magnetic sender disc is costly.

BRIEF SUMMARY OF THE INVENTION

Advantageous embodiments of the electronic pipette are revealed in the sub-claims.

The electronic pipette according to the invention has a displacement device, an electric drive motor with a drive shaft, a gear mechanism coupled on the one hand to the displacement device and on the other hand to the drive shaft, a magnetic disc rotatably coupled to the drive shaft with at least one magnetic pole on the circumference, at least one magnetic sensor aligned with the circumference of the magnetic disc, at least one additional magnet aligned with the circumference of the magnetic disc, an electronic control device electrically connected to the electric drive motor and the magnetic sensor and an electric voltage supply connected to the electronic control device.

In the electronic pipette according to the invention, the position of the magnetic disc is detected principally in the conventional manner by means of the magnetic sensor, which emits a signal when a magnetic pole of the magnetic disc passes by. Additionally, the additional magnet acts on the magnetic disc such that, at the beginning and at the end of a revolution by means of the motor, with one magnetic pole it is aligned precisely with a magnetic pole of the additional magnet. Thus the centre of a magnetic pole of the magnetic disc is always precisely aligned with the centre of an antilogous magnetic pole of an individual additional magnet. As a result, it is achieved that the magnetic disc always has a precisely defined position at the beginning and at the end of the positioning. Therefore, by means of the signals of the magnetic sensor which in themselves are only an approximate measurement of the rotary position of the magnetic disc, it is possible to detect the precise rotary position of the magnetic disc. The displacement device is driven and the test fluid metered with corresponding precision.

The electronic pipette namely does not allow the volume of fluid to be metered to be adjusted at will. However, it does allow the highly precise adjustment of discrete fluid volumes, where the magnetic disc is held in a precisely defined position by the additional magnet. The resolution of the setting of the fluid volume to be metered depends in particular on the transmission ratio of the gear mechanism and the number of magnetic poles on the magnetic disc. Preferably, the resolution of the setting of the volume of fluid to be metered is adjusted to the resolution of a display device for the adjusted volume of fluid (for example, a digital display) and/or to the resolution of an input device (for example a keypad) to adjust the volume of fluid to be metered. Then each displayable or adjustable volume of fluid can be metered by means of the electronic pipette. The adjustable volumes of fluid are always very precisely adhered to, due to the adjustment of the magnetic disc effected by the additional magnet into a defined angular position at the end of the adjustment of the magnetic disc by the drive motor.

According to an embodiment, the electric drive motor is a DC motor. In particular, in the embodiment of the electronic pipette as a hand-held pipette, the DC motor is advantageous due to the low energy consumption and the small structural volume compared to known electronic pipettes which comprise a step motor for precise control of the amount to be metered. The precise control of the drive movement is achieved with the DC motor by the magnetic rotational angle sensor, together with the additional magnet.

According to an embodiment, the displacement device comprises a cylinder and a piston displaceable therein and coupled to the gear mechanism.

According to an embodiment, the electronic pipette comprises a fastening shoulder for a pipette tip releasably attached thereto and the displacement device is attached to an aperture in the end of the fastening shoulder via a connection channel. This embodiment is an air cushion pipette.

According to a further embodiment, the electronic pipette comprises a fastening device for a syringe and a coupling device for releasably attaching a piston of the syringe to the gear mechanism. This embodiment is a direct displacement pipette.

The gear mechanism preferably transfers the rotary movement into a linear movement. Different embodiments of the gear mechanism are possible. According to an embodiment, the gear mechanism comprises a spindle nut rotationally coupled to the drive shaft and a rotationally fixed spindle comprising a threaded engagement with the spindle nut and coupled to the displacement device.

According to an embodiment the magnetic disc comprises a plurality of different magnetic poles on the circumference. As a result, the positioning accuracy is increased. Preferably, antilogous poles are arranged adjacent to one another, so that the frequency deviation of the signal emitted by the magnetic sensor is particularly great. Preferably, the different magnetic poles are evenly distributed over the circumference of the magnetic disc.

The number of magnetic poles required for desired metering precision depends on the diameter of the magnetic disc. For a design as a hand-held pipette, a magnetic disc with four to twenty pairs of magnetic poles of different polarity on the circumference is advantageous. According to a further embodiment, the magnetic disc comprises sixteen pairs of magnetic poles of different polarity on the circumference.

The magnetic disc can be coupled to a rotary driven part of the gear mechanism. According to an embodiment, the magnetic disc is directly fixed to the drive shaft.

According to an embodiment, a plurality of magnetic sensors are present, offset at an angle and aligned with the circumference of the magnetic disc. The precision of determining of the angle of rotation of the magnetic disc increases with the number of sensors. Moreover, a plurality of sensors allows the detection of the direction of rotation of the magnetic disc.

According to an embodiment, at least one magnetic sensor is a Hall-effect sensor, ie a sensor which is based on the use of the Hall effect. A control current for the Hall-effect sensor is, for example, provided by the electronic control device or directly provided by the electric voltage supply.

According to an embodiment, a plurality of additional magnets are present, offset at an angle and aligned with the circumference of the magnetic disc. A plurality of additional magnets have an increased magnetic interaction with the magnetic disc, compared to only one additional magnet. As a result, the positioning accuracy of the magnetic disc can be increased.

According to an embodiment, the angle between two additional magnets corresponds to the angle between two adjacent magnetic poles on the circumference of the magnetic disc. As a result, a particularly strong magnetic interaction is achieved when the magnetic poles are precisely aligned with the additional magnets and the positioning accuracy further improved.

In principle, the at least one additional magnet can be an electromagnet which is powered by the electronic control device or directly by the electric voltage supply, the switching on of the electromagnet being able to be restricted to the start and the end of the positioning.

According to an advantageous embodiment, the at least one additional magnet is a permanent magnet. Powerful permanent magnets of small size are available commercially.

When the electric drive motor is switched on at the end of the positioning of the magnetic disc, a positioning error results due to the load torque which is however substantially less than with conventional electronic pipettes with magnetic discs without additional magnets. According to an embodiment, the electronic control device switches off the electronic drive motor when it establishes, due to the signals emitted by the at least one magnetic sensor, that the magnetic disc has approached a predetermined position. By switching off the drive motor, the load torque decreases and the precise positioning is facilitated due to the magnetic interaction between the at least one additional magnet and the magnetic disc. Switching off the drive motor can result when the control device, due to a comparison of the signals with a limit value emitted by at least one sensor, detects that a magnetic pole to be aligned with the additional magnet has approached the additional magnet at a distance which is smaller than half the distance between two adjacent magnetic poles on the magnetic disc. Then it is ensured that the magnetic pole to be aligned, is aligned with the additional magnet after switching off the drive motor.

According to an embodiment, the electronic pipette comprises a input device (for example, a keypad) to set volumes of fluid to be metered and/or an output device (for example, digital display, LCD-display) in particular to display set volumes of fluid.

BRIEF DESCRIPTION OF SEVERAL VIEWS OF THE DRAWINGS

The invention will be described in more detail hereinafter with reference to the accompanying drawings of an embodiment, in which.

DETAILED DESCRIPTION OF THE INVENTION

Figure 1:
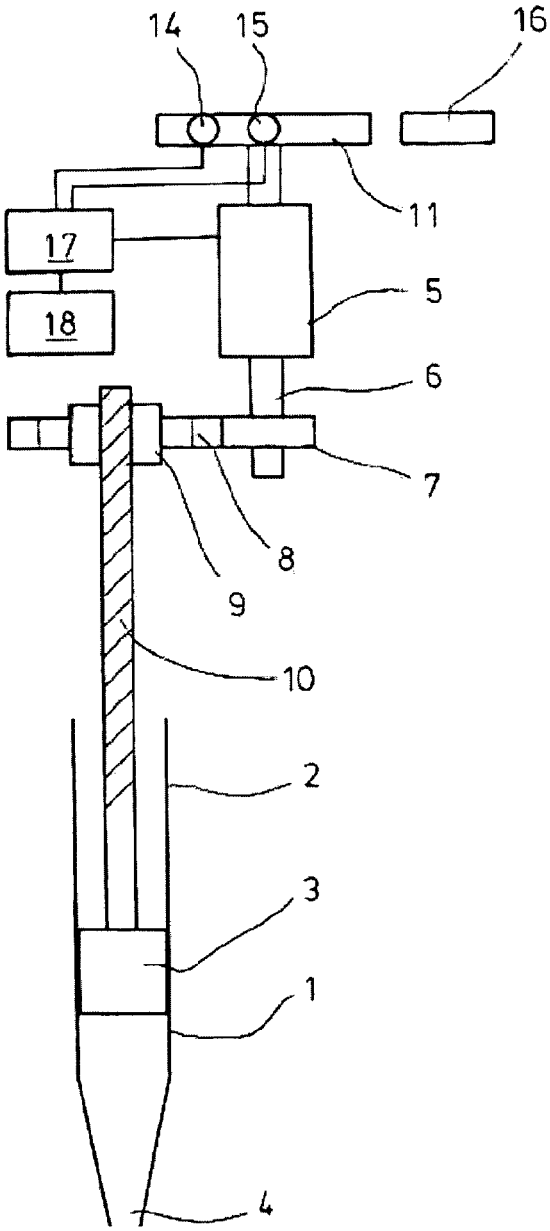
FIG. 1 shows components of an electronic pipette in a roughly diagrammatic block diagram.

While this invention may be embodied in many different forms, there are described in detail herein a specific preferred embodiment of the invention. This description is an exemplification of the principles of the invention and is not intended to limit the invention to the particular embodiment illustrated According to FIG. 1 an electronic pipette has a displacement device 1, which comprises a cylinder 2 with a piston 3 longitudinally displaceable therein. Releaseably (air cushion pipette) or individually (direct displacement pipette) attached to the cylinder 2 is a tip 4 which is a pipette tip or a syringe tip.

Moreover, the pipette comprises an electric drive motor 5, which comprises a drive shaft 6. The drive motor is a DC motor.

On a portion of the drive shaft 6 a small pinion 7 is positioned which meshes with a large pinion 8 which is rotationally fixedly attached to a spindle nut 9.

The spindle nut 9 is screwed onto a threaded spindle 10. The threaded spindle 10 can be axially displaced, but is guided unrotatably in the pipette. It is attached at one end to the piston 3, the connection being permanent with an air cushion pipette and releasable with a direct displacement pipette.

On a further portion of the drive shaft 6 a circular disc-shaped magnetic disc 11 is positioned. According to FIG. 2, the magnetic disc 11 has magnetic poles 12, 13 of different polarity on the circumference, in the circumferential direction the north pole N and the south pole S being alternately arranged. The magnetic poles 12, 13 belong to permanent magnets which are incorporated in the circumference of the magnetic disc 11. In the example, eight magnetic poles 12, 13 or four magnets with four pairs of magnetic poles 12, 13 are incorporated in the circumference of the magnetic disc 11.

Figure 2:
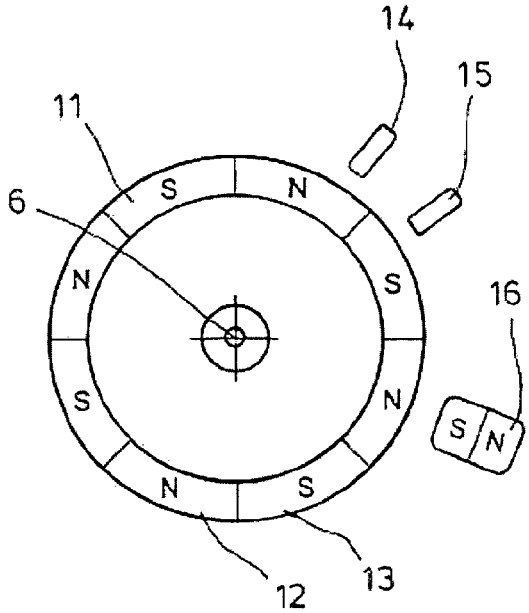
FIG. 2 shows a magnetic disc with magnetic sensors and additional magnet of the same pipette in an enlarged top view.

According to FIGS. 1 and 2 two magnetic sensors 14, 15 are aligned offset at an angle on the circumference of the magnetic disc 11. In this case, they are Hall-effect sensors.

Moreover, an additional magnet 16 is aligned with the circumference of the magnetic disc 11. In this case it is a permanent magnet. The angular separation of the additional magnet 16 from the magnetic sensors 14, 15 is selected such that a pair of magnetic poles 12, 13 is aligned with the angle bisector between the magnetic sensors 14, 15 when the additional magnet 16 is centrally aligned with a magnetic pole 12, 13.

The magnetic sensors 14, 15 and the additional magnet are fixedly arranged in the pipettes, for example as they are fixed in a housing, not shown, of the pipette.

Moreover, the pipette comprises an electronic control device 17 which is connected to the electric drive motor 5 and the magnetic sensors 14, 15.

Moreover, it has an electric voltage supply 18 which powers the electronic control device 17, the electric drive motor 5 and the Hall-effect sensors 14, 15. The electric voltage supply 18 in the embodiment of the pipette as a hand-held pipette is a battery, an accumulator or a power supply unit.

The electronic control device 17 comprises control elements, not shown, of an input device, by means of which the laboratory personnel can adjust, for example, operating modes (for example pipetting or dispensing) and volumes of fluid to be metered and initiate and stop metering processes. According to an embodiment, the electronic control device 17 comprises a dispensing device, not shown, in particular for dispensing and displaying the volume of fluid to be metered, the working mode of the electronic pipette (for example, pipetting, dispensing, mixing), its status (for example, on/off, battery charging).

When the electric drive motor 5 operates during a metering process, the magnetic disc 11 rotates and the magnetic sensors 14, 15 emit an alternating signal which is processed by the electronic control device 17. From this, the electronic control device 17 roughly detects the angle of rotation of the magnetic disc 11 and thus the displacement of the piston 3 driven via the pinion 7, 8, the spindle nut 9 and the threaded spindle 10.

Solely by processing the signals emitted by the magnetic sensors 14, 15, it has not previously been possible in the prior art to establish precisely the angle of rotation of the magnetic disc 11, as by means of the magnetic sensors 14, 15 it can merely be established that the magnetic poles 12, 13 are located in a specific region which is dependent on the width of the magnetic poles 12, 13 which cannot be reduced at will.

By means of the additional magnet 16, it is however achieved that at the end of a positioning the magnetic disc 11 is always centrally positioned with one magnetic pole 12, 13 on the centre of the additional magnet 16. In the example, a north pole N of the magnetic disc 11 is always positioned on the additional magnet 16, as this is aligned with the magnetic disc 11 with a south pole S. Thus the magnetic disc 11 is centred with the additional magnet 16, due to the magnetic interaction of the magnetic poles 12, 13. They are 'magnetically latched together'.

Thus in the pipette according to the invention, the electronic control device 17 can associate a definite rotary position of the magnetic disc 11 with the signals emitted by the magnetic sensors 14, 15.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. Electronic pipette with a displacement device (1), an electric drive motor (5) with a drive shaft (6), a gear mechanism (7 to 10) coupled on the one hand to the displacement device (1) and on the other hand to the drive shaft (6), a magnetic disc (11) rotationally coupled to the drive shaft (6) with at least one magnetic pole (12, 13) on the circumference, at least one magnetic sensor (14, 15) aligned with the circumference of the magnetic disc (11), at least one additional magnet (16) aligned with the circumference of the magnetic disc, an electronic control device (17) electrically connected to the electric drive motor (5) and the magnetic sensor (14, 15) and an electric voltage supply (18) connected to the electronic control device (17).

2. Electronic pipette according to claim 1, in which the electric drive motor (5) is a DC motor.

3. Electronic pipette according to claim 1, in which the displacement device (1) comprises a cylinder (2) and a piston (3) displaceable therein and coupled to the gear mechanism (7 to 10).

4. Electronic pipette according to claim 1, which comprises a fastening shoulder for a pipette tip (4) which can be releasably attached thereto and in which the displacement device (1) is attached to an aperture in the end of the fastening shoulder via a connection channel.

5. Electronic pipette according to claim 1, which comprises a fastening device for a syringe and a coupling device for releasably connecting a piston (3) of the syringe to the gear mechanism (7 to 10).

6. Electronic pipette according to claim 1, in which the gear mechanism (7 to 10) comprises a spindle nut (8) rotationally coupled to the drive shaft (6) and a rotationally fixed spindle (10) in threaded engagement with the spindle nut (8) and coupled to the displacement device (1).

7. Electronic pipette according to claim 1, in which the magnetic disc (11) comprises alternate magnetic poles (12, 13) of different polarity on the circumference.

8. Electronic pipette according to claim 7, in which the magnetic poles (12, 13) are evenly distributed along the circumference of the magnetic disc (11).

9. Electronic pipette according to claim 1, in which the magnetic disc (11) comprises four to twenty pairs of magnetic poles (12, 13) with differing polarity on the circumference.

10. Electronic pipette according to claim 9, in which the magnetic disc (11) comprises sixteen pairs of magnetic poles (12, 13) on the circumference.

11. Electronic pipette according to claim 1, in which the magnetic disc (11) is directly fixed to the drive shaft (6).

12. Electronic pipette according to claim 1, which comprises magnetic sensors (12, 13) offset at an angle and aligned with the circumference of the magnetic disc (11).

13. Electronic pipette according to claim 1, in which at least one magnetic sensor (14, 15) is a Hall-effect sensor.

14. Electronic pipette according to claim 1, which comprises additional magnets (16) offset at an angle and aligned with the circumference of the magnetic disc (11).

15. Electronic pipette according to claim 14, in which the angle between the additional magnets (16) corresponds to the angle between two adjacent magnetic poles (12, 13) or a whole number multiple thereof.

16. Electronic pipette according to claim 1, in which at least one additional magnet (16) is a permanent magnet.

17. Electronic pipette according to claim 1, in which the electronic control device (17) switches off the electric drive motor (5) when it establishes from the signals emitted by the at least one magnetic sensor (14, 15) that the magnetic disc (11) has approached a predetermined position.

18. Electronic pipette according to claim 1, in which the electric voltage supply (18) is an accumulator, a battery or a power supply unit.

19. Electronic pipette according to claim 1, which is a hand-held pipette.

* * * * *